US006702141B1

(12) United States Patent
Cinque

(10) Patent No.: US 6,702,141 B1
(45) Date of Patent: Mar. 9, 2004

(54) ONE-HANDED REFRESHMENT CENTER

(76) Inventor: Richard Cinque, 7040 Avenida Encinas, No. 104-278, Carlsbad, CA (US) 92009-4652

( * ) Notice: Subject to any disclaimer, the term of this patent is extended or adjusted under 35 U.S.C. 154(b) by 0 days.

(21) Appl. No.: 10/370,273

(22) Filed: Feb. 19, 2003

(51) Int. Cl.[7] ..... A47G 19/00
(52) U.S. Cl. ..... 220/575; 220/556; 220/23.86
(58) Field of Search ..... 220/575, 23.8, 220/23.86, 556, 735, 737

(56) References Cited

U.S. PATENT DOCUMENTS

| | | | | |
|---|---|---|---|---|
| 2,307,882 A | | 1/1943 | Freud et al. | |
| D168,327 S | | 12/1952 | Alper | |
| 2,916,180 A | | 12/1959 | Alger | |
| 4,989,742 A | | 2/1991 | Powell | |
| 5,184,750 A | * | 2/1993 | Moller | 220/575 |
| 5,353,952 A | * | 10/1994 | Donche | 220/575 |
| 5,429,266 A | | 7/1995 | D'Oliverira et al. | |
| 5,598,944 A | | 2/1997 | Aragona | |
| 5,607,077 A | | 3/1997 | Torkelson | |
| 5,697,512 A | | 12/1997 | Brickley | |
| 5,769,264 A | * | 6/1998 | Lipkowitz | 220/575 |
| 5,947,011 A | * | 9/1999 | Xu | 99/357 |
| 5,950,856 A | | 9/1999 | Cinque | |
| 6,129,235 A | * | 10/2000 | Creske | 220/575 |

* cited by examiner

*Primary Examiner*—Joseph Man-Fu Moy
(74) *Attorney, Agent, or Firm*—Knobbe, Martens, Olson & Bear, LLP.

(57) ABSTRACT

A refreshment center capable of holding a plate and a beverage container, formed of a rigid mold having first and second ends, a recessed portion sized to receive and hold a plate in the first end, and a hole and at least one L-shaped prong located in the second end to receive and hold almost any type of beverage container.

4 Claims, 5 Drawing Sheets

ONE-HANDED REFRESHMENT CENTER

FIELD OF THE INVENTION

The present invention relates to a refreshment center suitable for use in parties to permit an individual to carry both a plate and a beverage container comfortably with one hand.

BACKGROUND OF THE INVENTION

Party-goers are often faced with difficulties in dealing with food and beverage. In particular, at a stand-up function, such as a buffet, in which food and beverages are served, it is awkward to try to carry both a plate and a beverage container. In such social functions, one often has to shake hands and perform other tasks. Handshaking, opening doors, gesturing, handing out business cards, and other motions are all impeded if both hands are occupied holding a plate and a beverage container. Similarly, with a beverage container in one hand and a plate in another, a party-goer is hard pressed to consume the food on the plate.

In an effort to consume their food, some party-goers will awkwardly consolidate the beverage container and plate into one hand while eating with the other. Other party-goers will take their food and beverage to a table in order to eat. When a party-goer stations himself at a table, his ability to mingle and socialize with other party-goers is impeded. Recognizing this, party-goers eager to socialize will often eat their food rapidly at a table. This can lead to an upset stomach and take away from the party-goer's enjoyment of his food.

Many food establishments serve their customers on trays. The tray can typically hold a plate of food, utensils, and beverage. However, such conventional trays are too large or bulky for party-goers. In addition, most trays cannot be carried comfortably unless two hands are used. Moreover, only a slight incline of the tray causes the drink to tip or slide, with potentially embarrassing results.

Other trays in the prior art are limited in the types of beverage containers they can hold. For example U.S. Pat. No. 5,950,856 to Cinque, is designed only to hold tapered or stemmed containers. Bottles, aluminum cans, cylindrical, non-tapered, and beverage containers with small diameters would either not fit into this plate and cup holder or they would fall through. Other prior art food trays include beverage holders with solid bottoms such as U.S. Pat. No. 5,697,512 to Brickley and U.S. Pat. No. 5,607,077 to Torkelson. These types of trays are inadequate for holding wine glasses including stemmed containers, and other top-heavy beverage containers.

Another limitation of the holder disclosed in U.S. Pat. No. 5,950,856 is that it encourages a user to insert his fingers through multiple openings in order to hold it (see Column. 4, lines 20–22). This method of holding can be uncomfortable as it results in unnecessary stress on the user's fingers and makes the refreshment center difficult to balance.

Accordingly, there is a need for party-goers to comfortably carry almost any type of beverage container, a plate, eating utensils, and other related food items while still having one hand free to eat, shake hands, gesture, and perform other similar party movements.

SUMMARY OF THE INVENTION

In certain embodiments the refreshment center includes a rigid mold having first and second ends. Advantageously, the first end can have a first circular recessed portion adapted to be sized and receive and hold a plate having a first diameter. Preferably, the second end connects to and extends to one side of the recessed portion and includes a circular hole therein for receiving and holding a beverage container, said circular hole further having a slot therethrough into the circular hole to permit passage of a stem of a stemmed glass or handle of a mug, said second end further including at least one L-shaped prong for supporting the bottom of a beverage container, connected to and extending downward from the second end, so that by holding said mold, a user can simultaneously carry both the beverage container and the first plate. In preferred embodiments, the refreshment center includes at least three L-shaped prongs.

In other embodiments, the first end of the refreshment center further includes a second, smaller recessed portion located concentrically within the first recessed portion for holding a plate having a second, smaller diameter.

In further embodiments, the second recessed portion includes a bottom having a relatively flat region, and a bottom opening, extending above and on one side of the relatively flat region, for insertion of a thumb for gripping the refreshment center.

In some embodiments, it is advantageous for the refreshment center to include a neck which joins the first and second end. It is preferred that the neck includes at least one hole for at least one utensil. In preferred embodiments the refreshment center includes three utensil holes. It is also preferred that the neck includes at least one hole for at least one napkin. The neck can also include at least one recessed area. The neck can also include a hole for an ID stick or toothpick to be situated in. In certain embodiments the ID stick can be a toothpick.

Additional embodiments relate to a refreshment center having a first end and a relatively smaller second end; a recessed portion in the first end for receiving a plate, surrounded at least in part by a periphery; a drink receptacle in the second end; a bottom portion on the first end, the bottom portion having a first side opposite the second end and a second side adjacent the first side; a gripping opening in the first side of the bottom of the refreshment center, configured to allow the insertion of a user's thumb into the opening so that the thumb is pointing in the direction of the second end, wherein the bottom of the refreshment center is sufficiently below the periphery so that a plate in the recessed portion would be spaced above a user's thumb inserted into the gripping opening.

In preferred embodiments, the refreshment center can further include a support surface on the second side of the bottom, opposite the gripping opening, adapted to be supported by one or more fingers of a user when the user's thumb is inserted into the gripping opening. The refreshment center can also include a raised ridge in the bottom of the refreshment center inside of the gripping opening.

Further embodiments relate to a refreshment center, wherein the drink receptacle includes a side portion surrounding and defining a drink container area having an open top and bottom; a slot through the side portion into the drink container area of sufficient dimension that the stem of a glass can pass therethrough into the drink container area; and one or more horizontally-extending container supports extending into the drink container area below the side portion.

DETAILED DESCRIPTION OF THE PREFERRED EMBODIMENT

Refreshment Center in General

The refreshment center as described herein is not a tray in the conventional sense. Instead, its securely holds almost any type of beverage container and one or more plates and combines the two into a unitary article. In some embodiments, the refreshment center can be tilted, waved about, and otherwise handled in a manner typical of partygoers, while still retaining the beverage container and the plate and avoiding spilling food or drink.

As will be appreciated from the Figures and the foregoing description, the refreshment center 10 is relatively compact. It holds the beverage container and the plate, but unlike a tray, it does not occupy additional unnecessary area. In preferred embodiments, the refreshment center 10 is generally oval or ellipsoid in shape. Most of the area of the refreshment center 10 is taken up by the plate 20 and the beverage container. In other preferred embodiments, at least 60%, 70%, 80%, or even 90% of the surface area of the refreshment center 10 is taken up by the plate 20 and the beverage container.

Figure 3:
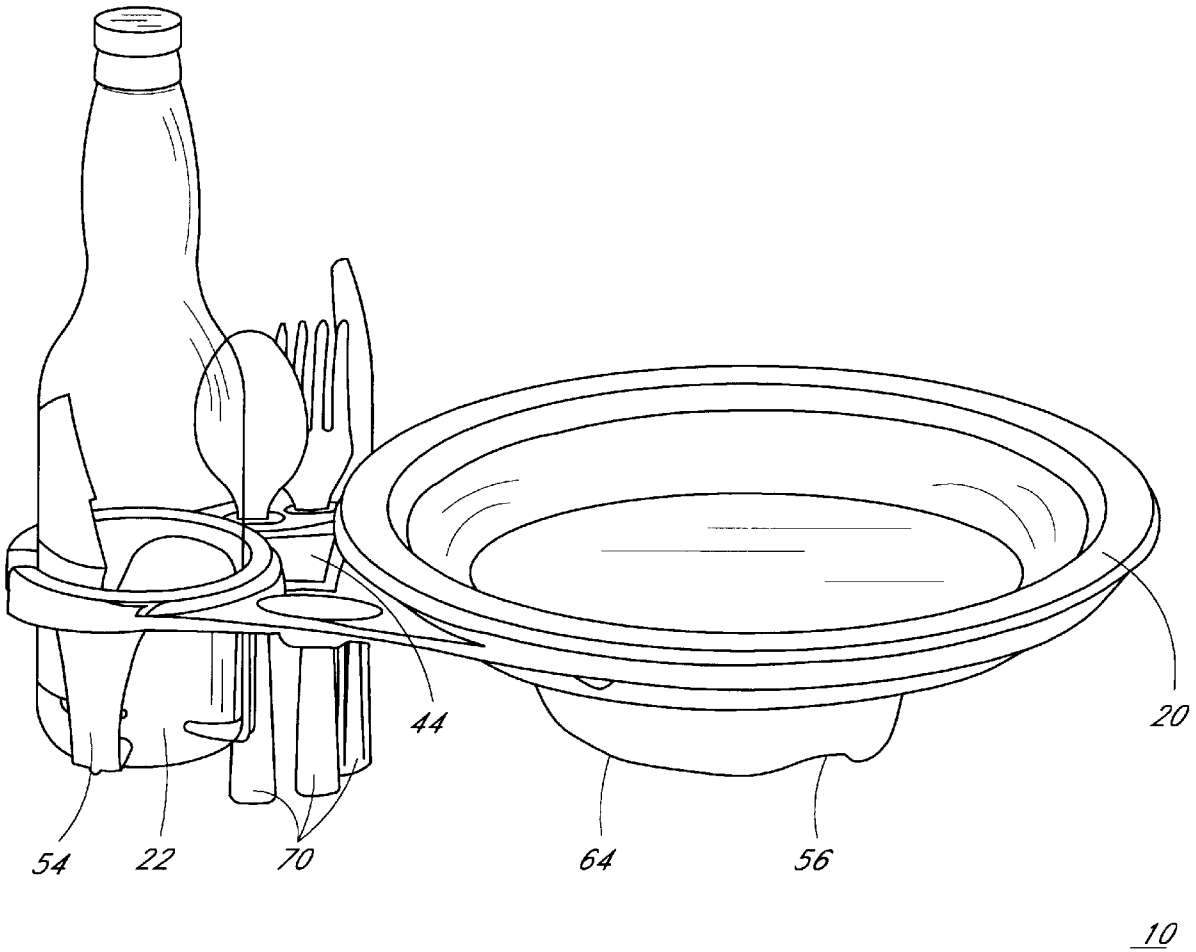
FIG. 3 is an angled top/side view of one embodiment of the refreshment center, illustrating its utility in holding a bottle, eating utensils, and a plate.
Figure 4:
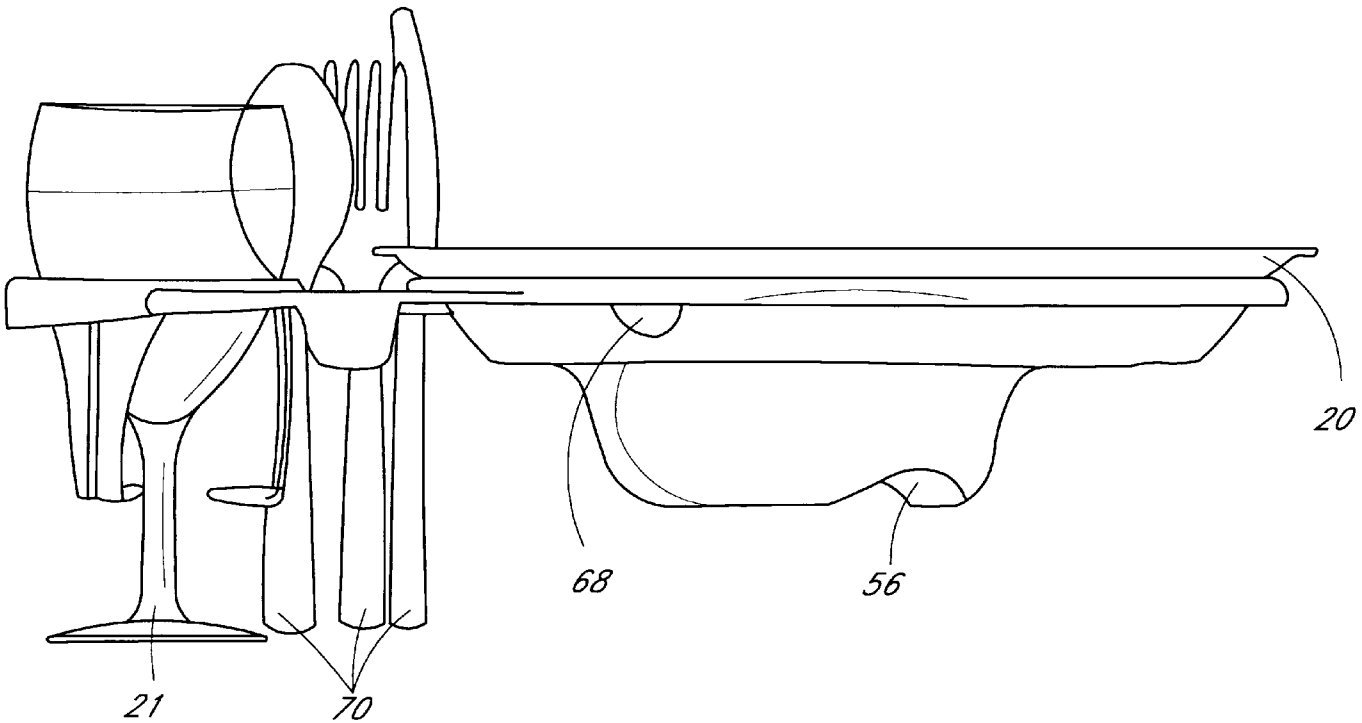
FIG. 4 is a side view of one embodiment of the refreshment center, illustrating its utility in holding a stemmed glass, eating utensils, and a plate.

The refreshment center 10 has a relatively large first end 14 joined to a relatively smaller second end 16. The first end 14 is adapted to hold a plate 20 (shown in FIG. 3) or a relatively shallow bowl (not shown). The second end 16 is adapted to hold a beverage container (a bottle 22 is shown in FIG. 3 and a stemmed glass 21 is shown in FIG. 4).

In certain embodiments, the entire refreshment center 10 can be about 10, 11, 12, 13, 14, 15, 16 inches long. In additional embodiments the first end 14 can be about 7, 7.5, 8, 8.25, 8.75, 9, 9.25, 10, 10.5, 10.75, 11, 11.25, 11.5, 11.75, 12, 12.5 inches wide. In other embodiments, the refreshment center can be about 1.5, 2.0, 2.5, 3.0, 3.5, 4, 4.5, 5, 5.5, 6, 6.5 inches in height.

With respect to FIGS. 1–5, embodiments of the refreshment center 10 include a mold 12 of relatively flat, rigid material. In some embodiments the mold 12 can be textured for gripping purposes. The mold 12 can be formed of any suitable material, such as a plastic (e.g., thermoplastic) or an equivalent material, such as paperboard or solidified polymer resin.

The entire refreshment center 10 is preferably formed of mold material 12 that is sufficiently rigid such that the refreshment center 10 can support a full plate 20 and beverage container without significant bending. This can be done by selecting a sufficient thickness of mold material 12, or through use of ribs 66 or other conventional reinforcing means (not shown).

First End

The first end 14 of the refreshment center 10 has a recessed portion 24 for holding the plate 20. The recessed portion 24 is preferably circular, and may be any suitable size for receiving a desired plate (e.g., 4", 5", 6", 8", 9", 10", 11", 12" or the like). A second recessed portion 25 may also be provided, located concentrically within the recessed portion 24, having a smaller diameter than the recessed portion 24 and extending below the recessed portion 24, adapted for holding a smaller plate than does the recessed portion 24. In this manner, one refreshment center 10 can be used with a variety of sizes of plates 20. Almost any type of plate can be held by the refreshment center 10 including, but not limited to ceramic, paper, and Styrofoam plates, for example. In certain embodiments the center 10 can provide additional support to plates made of relatively unstable material such as Styrofoam or paper, for example.

A periphery 26 may be provided surrounding the recessed portion 24. In certain embodiments the periphery 26 can extend radially outwardly from the recessed portion 24, around the outside of the first end 14. It is preferably generally horizontal. The periphery 26 may advantageously be sufficient wide to permit a user to grip it and support the entire refreshment center (e.g., about 1" or 2" wide). Alternatively, it can be relatively narrow, providing structural support but not necessarily a gripping surface. In certain embodiments, the periphery 26 surrounds the circular recess 24 and extends outwardly a uniform distance from the circular recess 24 for a least 180° of arc.

Figure 2:
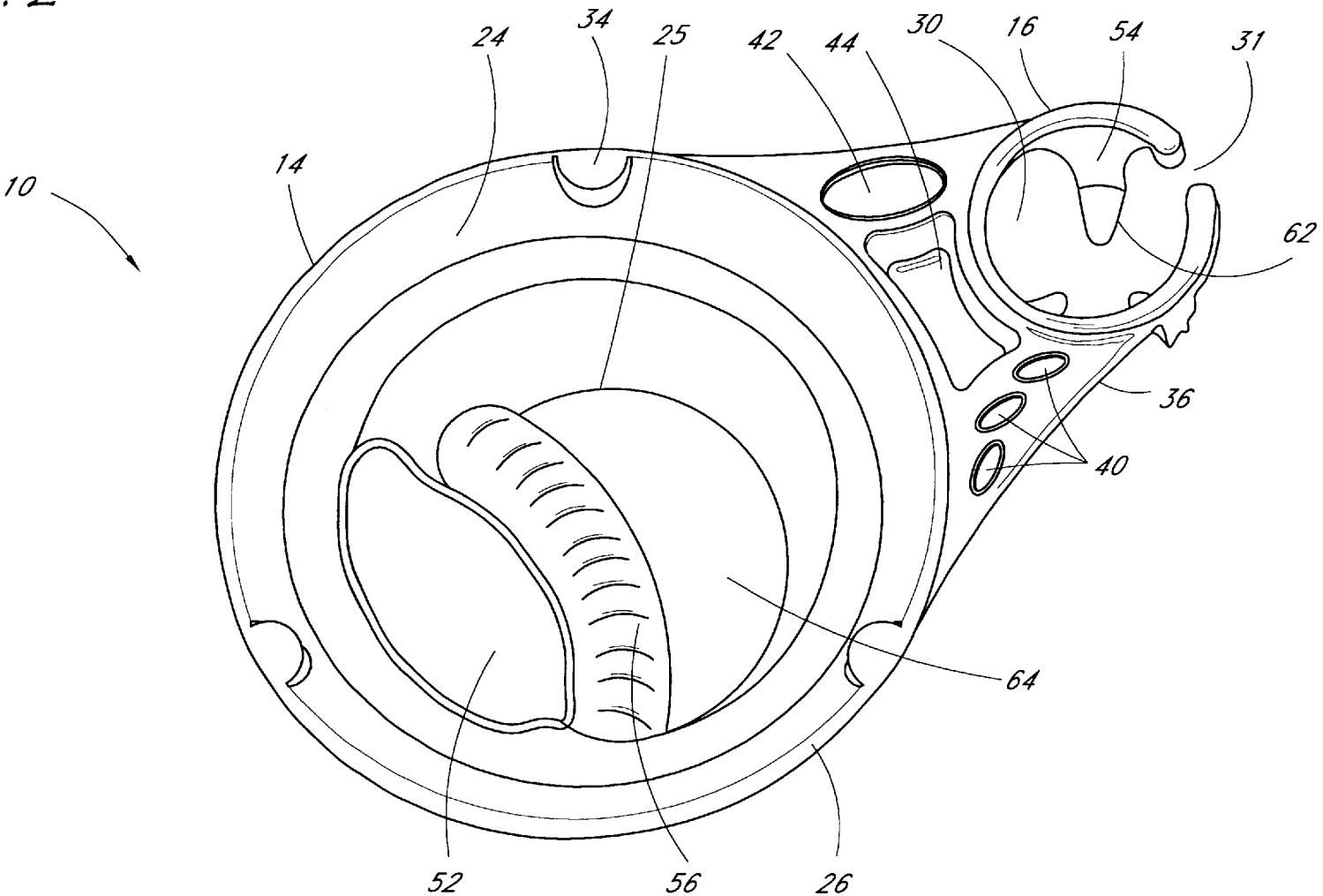
FIG. 2 is an angled top view of one embodiment of the refreshment center

In other embodiments, the refreshment center 10 is provided with a plate retainer 34 extending into or over the recessed area of the recessed portion 24 in the opposite direction of the periphery 26. In some embodiments, the plate retainer 34 can be a continuous lip (not shown) extending inward over the recessed portion 24. Alternatively, the plate retainer 34 can be a plurality of inwardly-extending tabs, as shown in FIG. 2 for example. In either embodiment (continuous lip or tabs), a relatively smaller plate can be secured underneath the plate retainer 34. Alternatively, plates with larger diameters can rest on top of the plate retainer 34. For embodiments where the plate retainer 34 are tabs, any suitable number can be provided including, but not limited to, 2, 3, 4, 5, 6, 7, 8, 9, 10 or more tabs. In certain embodiments, the plate tabs do not extend past the second periphery 25. In additional embodiments the recessed portion 24 has openings 68 below the tabs.

In other embodiments, the plate 20 sits loosely in the recessed portion 24. In this embodiment, the curvature of the recessed portion 24 preferably conforms to the curvature of the plate 20, so as to fictionally hold the plate 20 in place even when the refreshment center 10 is tipped to an angle of 5°, 10°, or even 20° or 30° from a horizontal position.

In further embodiments, the bottom of the refreshment center can have a relatively flat region 64, a concavo-convex groove 56 and a bottom opening 52. The flat region 64 allows for the refreshment center 10 to balance upright when placed on relatively flat surfaces. Accordingly, a user can place the center 10 on a surface such as a table, without having the center 10 topple over.

Figure 1:
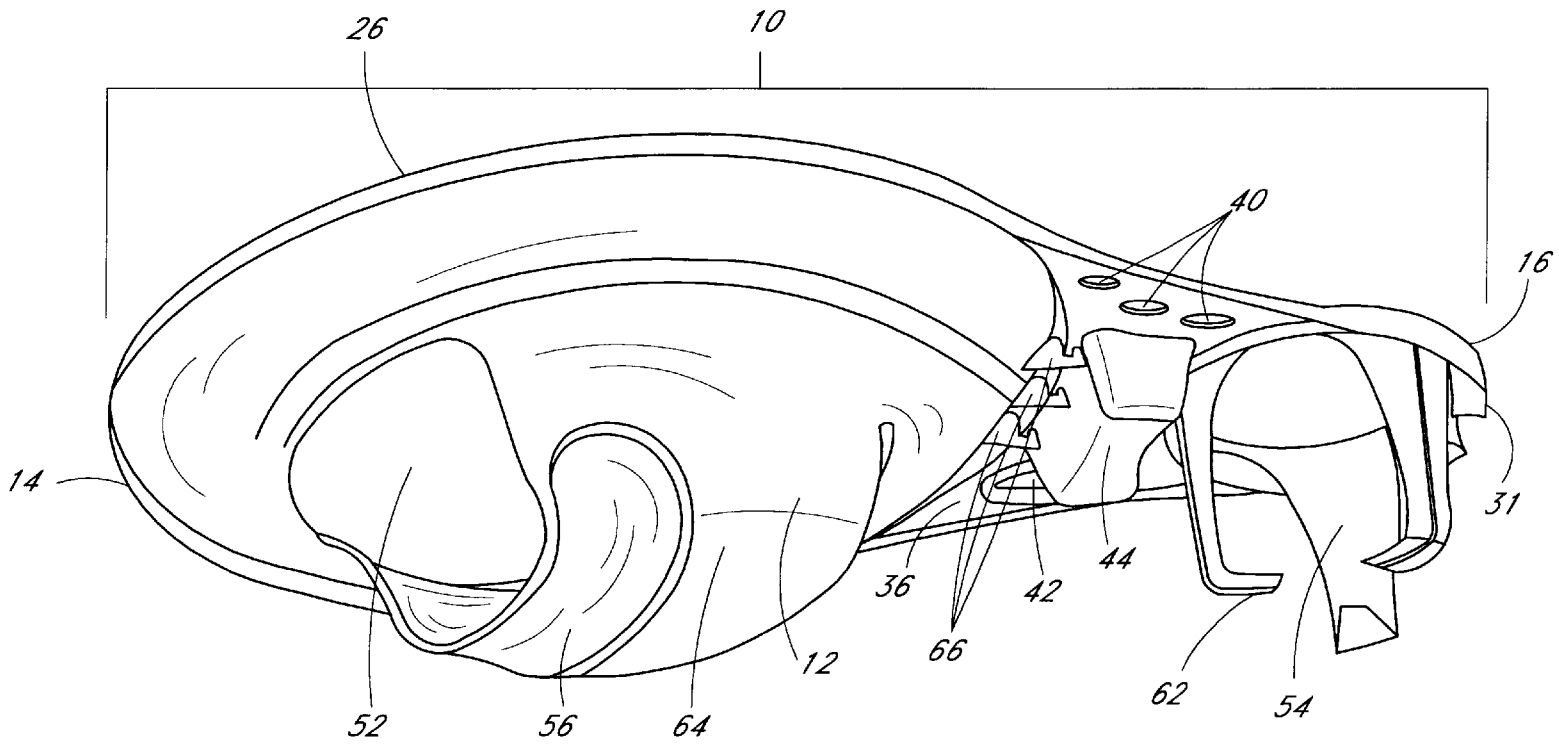
FIG. 1 is an angled bottom/side view of one embodiment of the refreshment center

As FIGS. 1 and 2 demonstrate, the groove 56 can be concave underneath the bottom and convex on top. In other embodiments, not depicted in the Figures, the bottom can have a convex grip on the top, without a concave groove on the underside (a substantially flat underside). In preferred embodiments, the convex topside of the groove 56 is configured so a user can grip it with his thumb. Typically if the user is right-handed, he will use his left thumb to grip the groove 56. The concave underside of the groove allows a user to comfortably use either the side of his index finger or the tips of multiple fingers to support the refreshment center 10. In other embodiments a user can place his fingers underneath the relatively flat region 64 of the bottom in order to grip the center 10. In some embodiments, one or both sides of the concavo-convex groove 56 can be textured to enhance its' gripping potential.

As demonstrated by FIG. 1, the bottom opening 52 can be relatively large and can extend upwards into the second recessed portion 25. Preferably, the bottom opening 52 allows the user to insert a thumb and comfortably grip the concavo-convex groove 56. It is also preferred that the bottom opening 52 is positioned so as to allow for a strong grip with support being very near the middle of the refreshment center 10. This allows the user to more easily balance the refreshment center 10 and allows for a more comfortable grip.

The bottom opening 52 can also facilitate easy removal of a plate from the first end 14. After finishing his meal, the user can insert his hand into the bottom opening 52 and easily dislodge the plate by pushing upward on the bottom surface of the plate. In certain embodiments, the periphery of the bottom opening 52 is smooth so a user is not aggravated by rough edges.

The bottom opening 52 is preferably located in the bottom and side of the refreshment center 10, in the first end 14 of the refreshment center 10, on a side of the bottom that is opposite the second end 16. When carrying a drink in the second end 16, the downward pressure of the user's thumb counteracts the tendency of the refreshment center 10 to tip towards the drink. In a complementary manner, the user's fingers, pressing upwardly against the other side of the bottom of the refreshment center 10, positively support the weight of a drink in the second end 16.

Because the refreshment center is designed to be held by a person's thumb on top of the concavo-convex groove 56, it is preferred that the groove 56 is a sufficient distance below the bottom of the plate 20 such that insertion of a thumb can be accomplished without dislodging the plate 20 or pinching the thumb. Appropriate distances could be, for example, but not limited to, about ¾ inch, 1 inch, or 1½ inches below the plate 20.

While most embodiments described herein are directed to holding a plate 20, further embodiments include holding a bowl (not shown) or similar container in the first end 14 of the refreshment center 10. Similar to a plate 20, it is preferred that the groove 56 is located a sufficient distance below the bottom of the bowl, for example, but not limited to, about ¾ inch, 1 inch, or 1½ inches below the bottom of the bowl.

The plate 20 or bowl may be inserted into and held by the recessed portion 24. Alternatively, the same refreshment center 10 can be used to hold a smaller plate or bowl in the second recessed portion 25. Still further, the plate 20 or bowl can be supported by the plate retainer 34.

Second End

The second end 16 of the refreshment center 10 includes a beverage container holder. In preferred embodiments, the beverage container holder is a hole 30 extending through the mold 12 at the second end 16 of the refreshment center 10. In preferred embodiments, at least one L-shaped prong 54 is attached to and extends downward from the second end 16. L-shaped prongs 54 are preferably made from the same material as the mold 12 (e.g. plastic) and can be used to support the bottom of both non-tapered and tapered beverage containers. In certain embodiments the prongs 54 can be about 1.5, 2.0, 2.5, 3.0, 3.5, 4, 4.5, 5, 5.5, 6, 6.5 inches long. Any sufficient number of prongs can be used, including, for example, 1, 2, 3, 4, 5, 6, 7, 8, 9, and 10 or more L-shaped prongs 54. Without at least one of these prongs 54, a generally cylindrical (non-tapered) beverage container would either not fit into the hole 30 or would fall through.

In certain embodiments the bottom tips 62 of the L-shaped prongs do not connect to one another. An example of this embodiment is illustrated in FIG. 4. This configuration allows for the refreshment center 10 to hold a stemmed glass, such as a wine glass for example. Accordingly, in certain embodiments, the bottom tips 62 are not used to support the bottom of the beverage container. This configuration of prongs 54 is superior to prior art food trays with beverage holders having complete bottoms such as U.S. Pat. No. 5,697,512 to Brickley and U.S. Pat. No. 5,607,077 to Torkelson, because these trays are inadequate for holding wine glasses and other stemmed or top-heavy beverage containers.

Additional embodiments include the bottom tips 62 being angled slightly upward to provide more support and grip to the bottom of the beverage container. The tips 62 can be angled upward about 5°, 10°, 20°, 30°, 40°, or more degrees, for example. In certain embodiments, this angle allows the tips 62 to better support the bottom of concave surfaces, such as aluminum cans. In additional embodiments, the prongs 54 and tips 62 can have some flex to them in order to accompany a variety of beverage containers with different circumferences. This flex action allows the prongs 54 and tips 62 to self adjust to containers inserted therein, thereby resulting in a snug hold and substantially reducing the chance of spillage. In further embodiments, the prongs 54 and tips 62 can have an outer ridge running down the middle for additional support.

The design of the L-shaped prongs 54 allows for the center 10 to hold almost any type of beverage container including, but not limited to cups, glasses, bottles, mugs (e.g. coffee cups, tea cups, beer mugs), stemmed glasses, tapered containers, cylindrical shaped and other non-tapered containers, small thermoses, cans, and the like. The L-shaped prongs 54 can also be used to hold beverage containers made from any type of material including, but not limited to glass, plastic, paper, wax coated paper, aluminum, pottery clay, stainless steel, crystal, and the like.

The hole 30 is sized appropriately so that almost any type of beverage container can sit in the hole 30. The beverage container preferably extends down in the hole 30 at least 30% of the height of the beverage container, more preferably 40%, 50%, 60%, or 75% of the height of the beverage container. When the beverage container extends into the hole 30 a significant portion of its height (preferably at least half of the height of the beverage container), it is stable and secure. The beverage container, held in this manner, is unlikely to fall out of the hole 30, even when the refreshment center 10 is tipped to a significant degree.

The hole 30 may be surrounded by the mold 12 for at least 270° of arc, preferably at least 300° or 330° of arc. In FIGS. 1–5 the hole 30 is completely surrounded by the mold 12, except for a slot 31 through the mold 12 at the second end 16, to allow a wine glass, another stemmed beverage container, or mug (e.g. coffee cups, tea cups, beer mugs and the like) to be held in the hole 30. Accordingly, the stem of the stemmed container can be inserted through the slot 31. Although not depicted in the Figures, a mug can be inserted in the hole 30 with it's handle extending through the slot 31.

With reference to FIGS. 1–5, it will be appreciated that with the accompanying slot 31 and prongs 54, almost any type of beverage container can be inserted into the hole 30 and held, in the second end 16 of the refreshment center 10.

Neck

The first end 14 and the second end 16 of the refreshment center 10 can be joined by a neck 36. This neck 36 may, in certain embodiments, be as wide as the hole 30, or even wider. When formed in this manner, the neck 36 provides a gripping area for holding the refreshment center 10. The neck 36, in the illustrated embodiment, tapers uniformly from a point on the periphery 26 surrounding the recessed portion 24 to a point adjacent to or even midway along the hole 30, and can advantageously define a straight line between said points.

In yet another preferred embodiment, the neck 36 may be significantly narrower than the hole 30. This further facilitates the compactness of the current design.

In still other embodiments, the refreshment center 10 is so compact that the mold 12 does not extend beyond the hole 30 or the recessed portion 24 more than 30% of the diameter of the recessed portion 24, preferably not more than 20%, 15%, or 10% of the diameter of the recessed portion 24, except perhaps in the area of the neck 36 between the first end 14 and the second end 16.

In preferred embodiments, the neck 36 can include one or more utensil holes 40 formed in the neck 36, sized such that the handle of a utensil 70 can pass through, but not the head of the utensil as shown in FIGS. 3 & 4. The neck 36 also preferably includes one or more napkin holes 42, into which a folded paper or cloth napkin can be inserted and frictionally held, similar to the way a napkin ring holds a napkin. If desired, the napkin hole 42 and the utensil holes 40 may be located with a recessed area 44 in he neck 36. The recessed area 44 is useful in holding condiments such as, but not limited to salt and pepper packages, ketchup, mustard, relish, barbecue sauce, hot sauce, and the like. The recessed area 44 can also hold useful meal items such as toothpicks, mints, and like.

Figure 5:
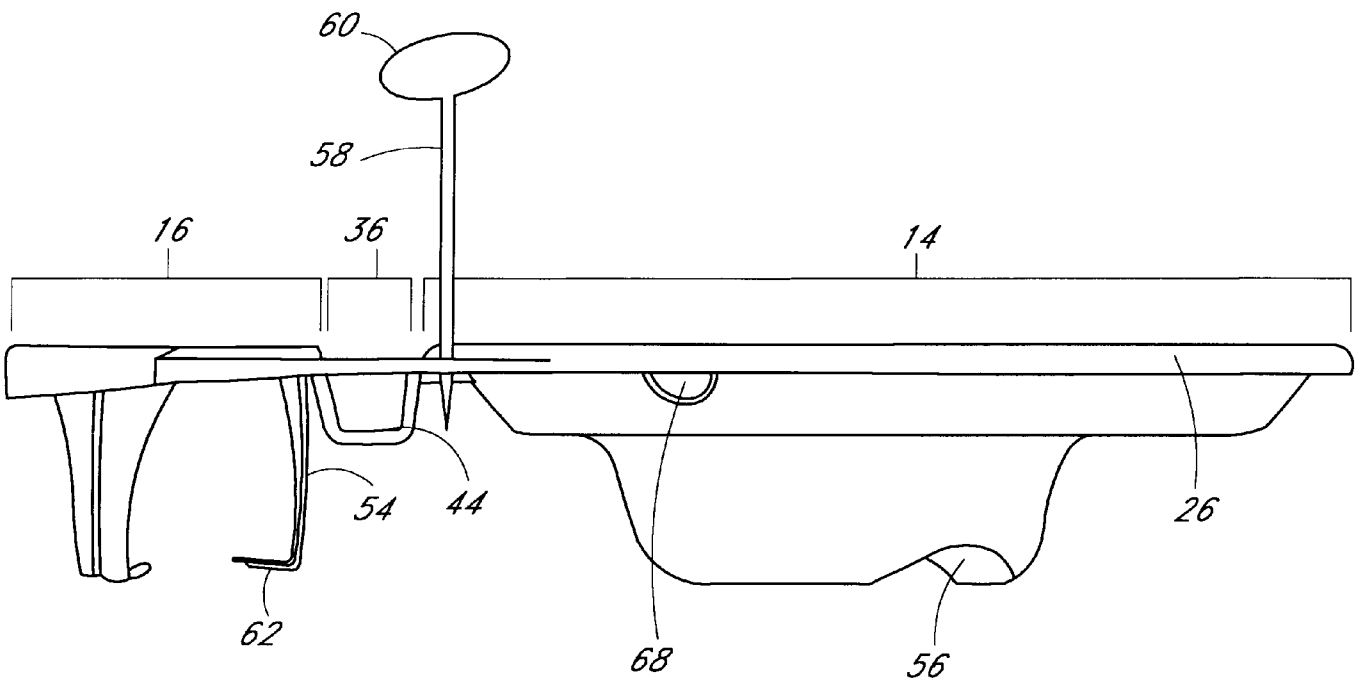
FIG. 5 is a side view of one embodiment of the refreshment center, illustrating its utilizing in holding an identification stick.

The neck 36 can also contain a hole (not shown), formed in the neck 36 and sized so that an identification (ID) stick 58 can be inserted and held therein. As shown in FIG. 5, the top of the ID stick 58 can contain a head 60 that is preferably facing outward from the user. The head 60 can include identifying information about the user such as his name or an affiliation with a group such as a company. In order to display said identifying information the head 60 can be angled towards the viewer at about 15°, 16°, 17°, 18°, 19°, 20°, 21°, 22°, 23°, 24°, 25°, 30°, 35°, 45°, 50°, 60°, 70°, 80°, 90°. In some embodiments the head 60 is about 1, 1.435, 2, 2.5, 3, 3.5, 4 inches wide. Additionally the head 60 can be about 0.5, 0.6, 0.7, 0.85, 0.9, 1, 1.5, 2 inches high, and about 0.05, 0.075, 0.1, 0.15, 0.2, 0.25, 0.3 inches thick. The ID stick 58 can be about 5, 4.5, 4, 3.5, 3, 2.5, 2, 1.5, 1 inches long, and it preferred that the stick 58 is tapered about 1.5, 1, 0.5 inches in order to situate it in the ID stick hole formed in the neck 36. In certain embodiments the stick 58 is a toothpick. In one embodiment, the ID stick 58 includes a clip, slot, or other structure for gripping or displaying a business card.

As demonstrated in FIG. 1, the underside of the neck 36 can contain supporting ribs 66. In certain embodiments the ribs 66 can connect the underside of the first end 14 to the underside of the recessed portion 44 and/or the neck 36. In certain embodiments about 1, 2, 3, 4, 5, 6, 7, 8, 9, or 10 supporting ribs 66 can be used.

Although the refreshment center has been described in the context of certain embodiments, it will be understood that the scope of the refreshment center is to be measured by the claims that follow, without limitation to particular preferred embodiments described herein.

What is claimed is:

1. A refreshment center, comprising:

a first end and a relatively smaller second end;

a recessed portion in the first end for receiving a plate, surrounded at least in part by a periphery;

a drink receptacle in the second end;

a bottom portion on the first end, the bottom portion having a first side opposite the second end and a second side adjacent the first side;

a gripping opening in the first side of the bottom of the refreshment center, configured to allow the insertion of a user's thumb into the opening so that the thumb is pointing in the direction of the second end, wherein the bottom of the refreshment center is sufficiently below the periphery so that a plate in the recessed portion would be spaced above a user's thumb inserted into the gripping opening.

2. The refreshment center of claim 1, further comprising a support surface on the second side of the bottom, opposite the gripping opening, adapted to be supported by one or more fingers of a user when the user's thumb is inserted into the gripping opening.

3. The refreshment center of claim 2, further comprising a raised ridge in the bottom of the refreshment center inside of the gripping opening.

4. The refreshment center of claim 1, wherein the drink receptacle comprises:

a side portion surrounding and defining a drink container area having an open top and bottom;

a slot through the side portion into the drink container area of sufficient dimension that the stem of a glass can pass therethrough into the drink container area; and one or more horizontally-extending container supports extending into the drink container area below the side portion.

* * * * *